343-700 MS AU 256 EX
8/29/78 OR 4,110,751

United States Patent [19]
Reggia et al.

[11] 4,110,751
[45] Aug. 29, 1978

[54] VERY THIN (WRAP-AROUND) CONFORMAL ANTENNA

[75] Inventors: Frank Reggia, Bethesda, Md.; Howard S. Jones, Jr., Washington, D.C.

[73] Assignee: The United States of America as represented by the Secretary of the Army, Washington, D.C.

[21] Appl. No.: 776,161

[22] Filed: Mar. 10, 1977

[51] Int. Cl.[2] ..... H01Q 13/18; H01Q 1/38
[52] U.S. Cl. ..... 343/700 MS; 343/705; 343/770
[58] Field of Search ..... 343/700 MS, 705, 708, 343/770

[56] References Cited

U.S. PATENT DOCUMENTS

| | | | |
|---|---|---|---|
| 3,121,230 | 2/1964 | Brueckmann | 343/770 |
| 3,713,166 | 1/1973 | Munson et al. | 343/700 MS |
| 3,810,183 | 5/1974 | Krutsinger | 343/700 MS |
| 3,971,032 | 7/1976 | Munson et al. | 343/700 MS |
| 4,040,060 | 8/1977 | Kaloi | 343/700 MS |

*Primary Examiner*—Eli Lieberman
*Attorney, Agent, or Firm*—Nathan Edelberg; Robert P. Gibson; Saul Elbaum

[57] ABSTRACT

A new type of thin-walled dielectric loaded antenna which is capable of flush mounting to almost any surface contour. This very thin wrap-around antenna consists essentially of 2 modified cavity-backed slot radiators, spacially positioned 180° apart. Typically, a strip-line feed network is used to couple the microwave energy to the individual radiating slots. A plurality of plated through holes define the boundary for the strip-line feed network.

12 Claims, 5 Drawing Figures

VERY THIN (WRAP-AROUND) CONFORMAL ANTENNA

RIGHTS OF THE GOVERNMENT

The invention described herein may be manufactured, used, and licensed by or for the U.S. Government for governmental purposes without the payment to us of any royalty thereon.

BACKGROUND OF THE INVENTION

The present invention is related to conformal antenna and, more particularly, is directed towards very thin wrap-around antennas which are capable of being mounted on almost any surface contour.

Space limitations and size requirements often are deemed critical in many antenna applications, especially when they are mounted on the noses or cylindrical bodies of projectiles. These antenna must have low profiles to prevent drag, must be rugged enough to withstand harsh temperature and velocity environments, and yet must provide the desired radiation pattern. Conformal antennas which can be flush mounted to the exterior of a variety of surface contours provide a solution when such considerations are of importance. They also can be mounted on various projectiles with little or no modification to the projectile structure.

Conformal antennas, themselves, are not new to the antenna art. U.S. Pat. No. 3,475,755 to Bassen et al. discloses one approach to wrap-around mounting, the ring antenna. It comprises a dielectric ring having an inner copper cladded surface acting as the ground plane and a conducting strip open at one end and connected to the ground plane at the other. This antenna is fed directly through a hole in the dielectric ring by the center conductor of a rigid coaxial cable to a proper impedance point on the ring. This places restrictions both on the location of the feed point and the thickness of the ring itself.

Another form of an antenna adapted to be wrapped around the circumference of a missile is taught by Krutsinger et al. in U.S. Pat. No. 3,810,183. Again the antenna includes inner and outer radially spaced copper clad conductors which define a pair of paralled plates one-half wavelength long. It radiates in a microstrip mode where the instantaneous electric field at one end of the rectangular plate is oppositely directed to that at the other end of the parallel plates. The half wavelength plate is excited with a short probe placed at a high impedance point and thus requires a complex impedance matching network required for a standard 50 ohm input transmission line.

Prior conformal antennas, because of their design configuration, therefore have drawbacks which often limit their application. It is the development of a conformal antenna which overcomes these drawbacks to which this invention is directed.

OBJECTS AND SUMMARY OF THE INVENTION

It is therefore one object of the present invention to provide a thin-walled dielectric loaded antenna which is capable of flush mounting to almost any surface contour.

Another object of the present invention is to provide a conformal antenna which radiates on a constant phase front.

A further object of this invention is to provide a conformal antenna which allows for r.f. coupling to be made at any impedance values (for example 50 ohms) along the radiating slot.

Still another object of this invention is to provide a conformal antenna which requires essentially no additional space or modification of the body on which it is mounted.

A still further object of this invention is to provide a conformal antenna which can be fed from various points on the body upon which it is mounted.

The foregoing and other objects are attained in accordance with one aspect of the present invention by utilizing a very thin, wrap-around antenna which employs a cavity-backed technique to provide a constant phase front along the radiator. Essentially the antenna consists of two slot radiators positioned 180° apart on a very thin, conductively plated dielectric substrate. The slots are excited utilizing stripline techniques at a low impedance point (for example 50 ohms) of the slot radiator.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENT

Figure 1:
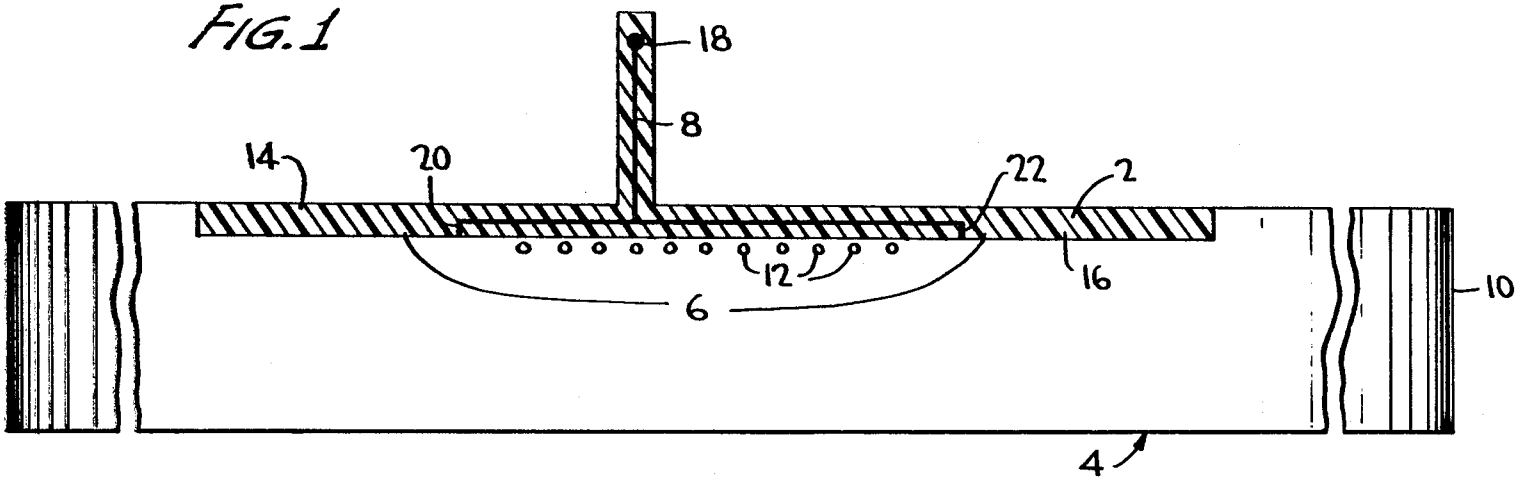
FIG. 1 is plan view which schematically illustrates a preferred embodiment of the thin wrap-around conformal antenna of the present invention.

Referring now to the drawings, wherein like reference numerals designate identical or corresponding parts throughout the several embodiments illustrated, FIG. 1 depicts schematically a plan view one of the preferred embodiments of the present invention which utilizes a cavity-backed technique. Basically it consists of a dielectric substrate 2 which is capable of flush mounting on almost any surface contour. The substrate, which can be for example Teflon-fiberglass, is coated on both exterior and interior sides 4 with a conductive metal such as copper plating. A portion of the antenna, indicated generally by reference numeral 6, is left unplated to form the cavity-backed slots and provide for transmission feed network 8. In this embodiment the edges 10 are also plated so as to short circuit the interior and exterior sides 4 and effectively form one end of the cavity for the radiator. The two slots 14 and 16 are positioned 180° apart around the cylindrical body. Conductive posts (plated-through holes) 12 are used to define the boundry of both the stripline feed network 8 and the other end of the cavity at the center of the antenna. For this particular antenna design, the individual slot radiators 14 and 16 are excited 180° out-of-phase to obtain maximum radiation in the forward direction of the projectile body. Input 18, feedline tab 8, and feeds 20 and 22 define the stripline feed network used to couple the microwave energy to the individual slots. Feed points 22 and 20 are chosen so they are impedance matched to the input, the maximum impedance being present at the center of each slot and lower toward the ends. Thus the cavity backed technique allows for rf coupling at a low impedance point (for example 50 ohms) of the slot radiator, eliminating any need for a complex impedance matching network.

Figure 2:
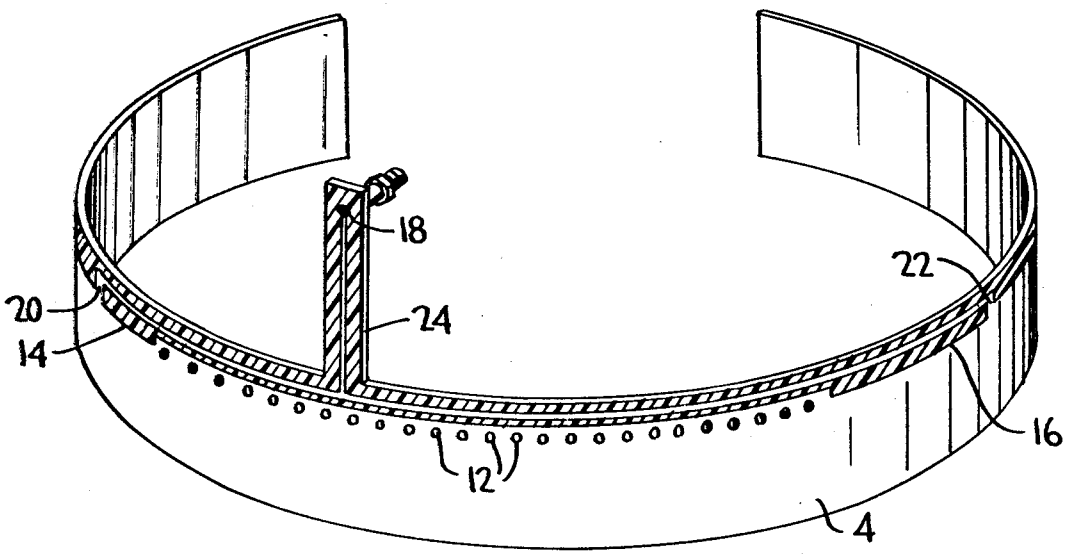
FIG. 2 is a perspective view of the embodiment illustrated in FIG. 1.

The width of the antenna is ¼ wavelength or, as designed at 1500 MHZ, a maximum 1½ inches. The cavity region, in vicinity of the plated through holes, as depicted in FIG. 2, is a bit less at 1.275 inches. The length of the slots can vary between ½ and 1 wavelength and for a working embodiment designed at 1500 MHZ on an 8 inch diameter cylinder as illustrated in FIG. 2, the lengths of the slots are 6 inches with a width of about 0.255 inch. This wrap-around antenna includes a 2½ inch long feed tab 24 on top (generally not required) which is used to extend the position of the feed point. The total thickness of this conformal antenna is 0.040 inch, including the 0.004 inch thick copper plating on both sides. (Designs have ranged from 0.020–0.060 inches in thickness).

Figure 3:
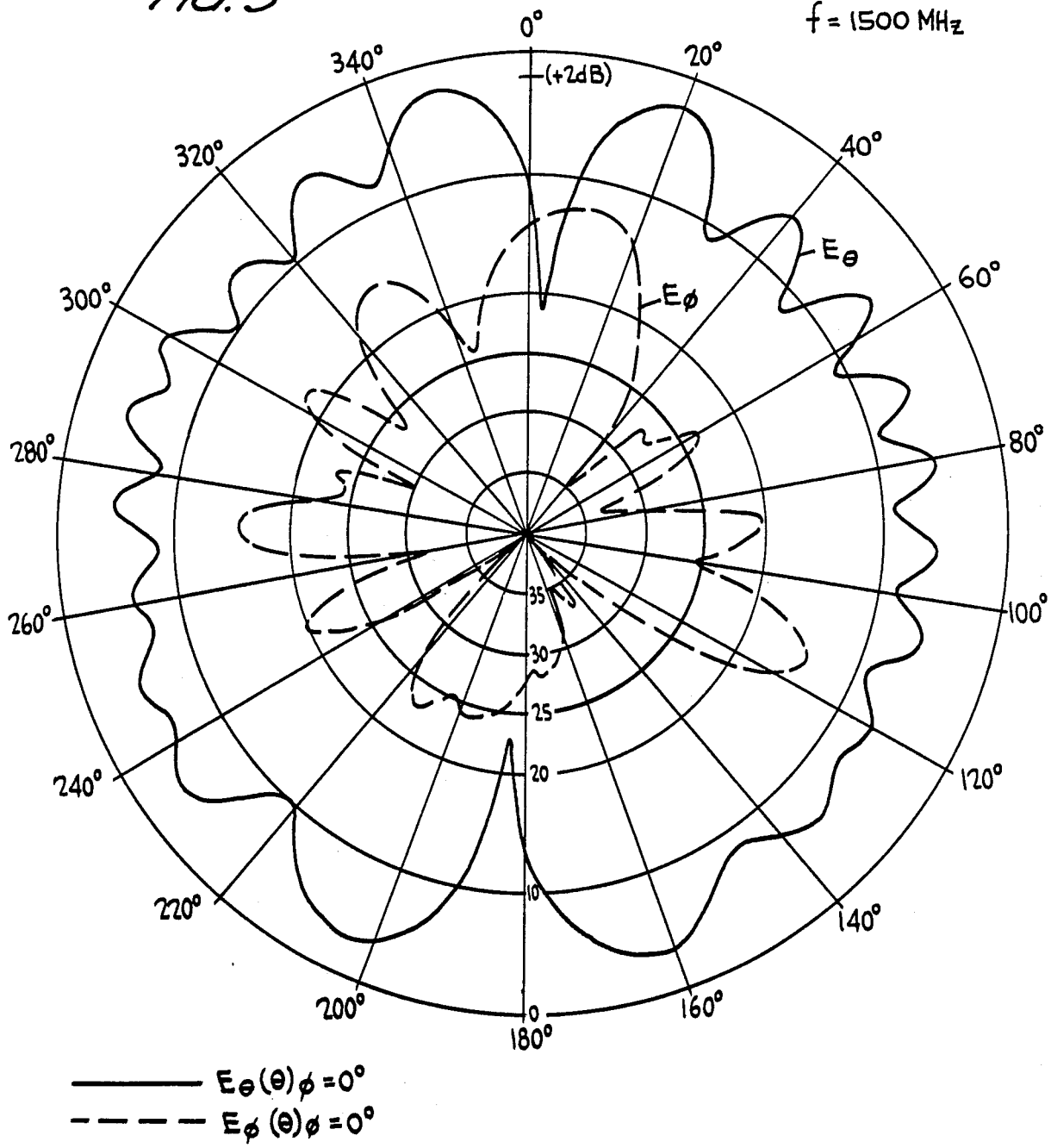
FIG. 3 illustrates graphically a typical far-field radiation pattern of the wrap-around antenna on an 8-inch diameter projectile body.

A typical far-field radiation pattern of the wrap-around antenna on an 8 inch diameter projectile body, taken in a plane through the center of the slot radiators and parallel to the projectile axis is shown in FIG. 3. For this particular antenna, operating at 1500 MHZ, the two slot radiators are excited in-phase. The E pattern is the normal (vertical) polarization characteristic of the slot radiators while the $E_{100}$ pattern is the cross-polarization component of the radiation field. The $TE_{10}$ mode is utilized in this cavity-backed antenna, the $TE_{10}$ being the fundamental mode for this closed cavity system.

Figure 5:
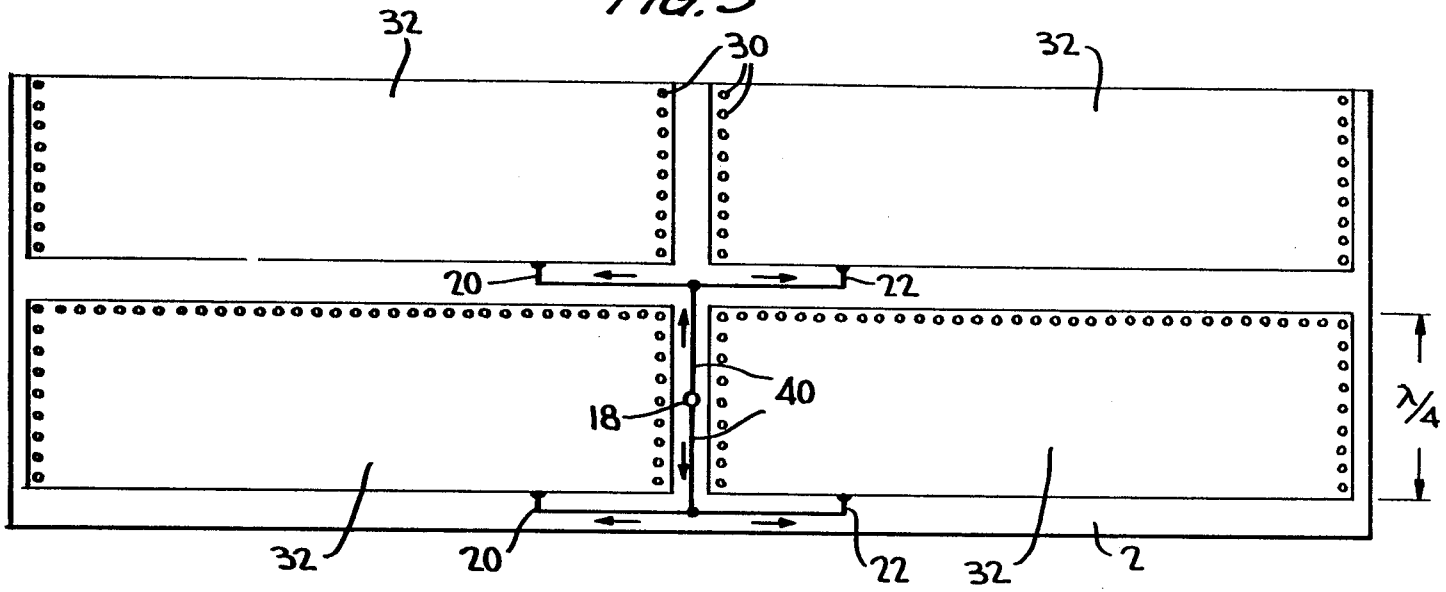
FIG. 5 is a plan view schematically illustrating a third preferred embodiment of the thin wrap-around conformal antenna of the present invention which can transmit and receive doublets.
Figure 4:
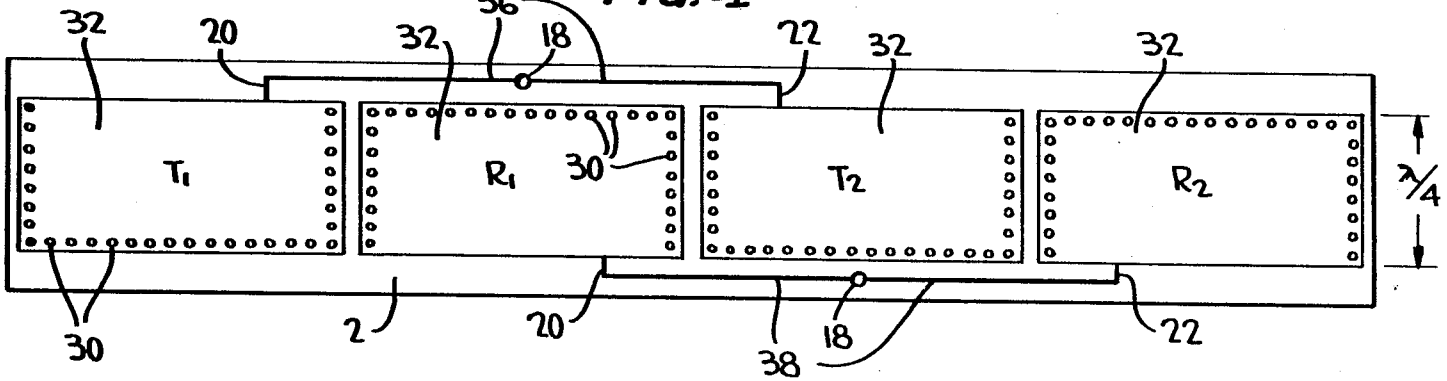
FIG. 4 is a plan view schematically illustrating another preferred embodiment of the thin wrap-around conformal antenna of the present invention which has available simultaneously both a transmitting and receiving antenna.

FIGS. 4 and 5 present alternate embodiments of the concept illustrated in FIG. 1. Instead of the entire surface area of dielectric substrate being copper cladded, only the ground plane is so. The exterior surface is divided into discrete plated zones 32, each creating a cavity-backed slot. Shorting posts (plated-through holes) 30 form the boundary for the slot radiators. Couplings 18 and impedance points 20 and 22 are chosen similarly to the antenna depicted in FIG. 1. Thickness and other fundamental dimensions are also similarly chosen. The elements 32 radiate very similarly to the dual slot configuration disclosed above, and both these antennas are adaptable to the same contours. However, their configurations permit them to operate in different modes.

The configuration of FIG. 4 describes a dual function mode. Plates 32, aligned linearly, are alternately fed by feedlines 36 and 38. Plates $T_1$ and $T_2$ can act as transmitting antennas, while plates $R_1$ and $R_2$ act as receiving antennas. This simultaneous functional capability, through the utilization of separate feed networks 36 and 38, can be a useful tool when these antennas are used on bodies such as reentry vehicles, projectiles, aircraft, and space craft.

FIG. 5 presents another system that has a variety of attributes. The balanced rf feed 40 is so designed so as to minimize radiation from the transmission line. The radiation beam may be shaped or redirected either by varying the feed point 18 or the spacing between the pairs or both. Since it is supplied with separate feeds it is able to either transmit or receive individual doublets.

While the present invention was designed to be used on projectile bodies, a variety of applications may be envisioned where contour matching, sizing, low cost, and low-profile consideration are major factors in design. They also have potential applications as conformal arrays on such bodies. Additionally, numerous variations and modifications of the present invention are possible in light of the above teachings. The number of elements, the configuration, the transmission line network, the number of systems, phase excitation, and method of shorting to form the cavity can be changed without departing from the spirit of this invention.

What we claim is:

1. A thin wrap-around, conformal antenna comprising:

a conformal dielectric substrate;

conductive plating on the interior surface of the substrate;

conductive plating on the exterior surface of the substrate, the plating defining a cavity region for a pair of radiating elements;

shorting means for forming the boundaries of the cavity-backed radiating elements placed along the periphery of the elements except for a single cavity radiating region on each element; and a stripline feed network for nonsymmetrically coupling energy to the individual radiating elements at selected points along the radiating region whereby microwave energy may be received or transmitted.

2. The antenna as set forth in claim 1 wherein the cavity-backed radiating elements are rectangular and the radiating region is along one edge of the element.

3. The antenna as set forth in claim 2 wherein the width of the antenna is approximately ¼ wavelength.

4. The antenna as set forth in claim 3 wherein the shorting means comprises:

a conductive plating over the entire surface of the substrate excluding a cavity region; and at least one conductive post used to define the boundary of both the stripline feed network and the top center of the cavity.

5. The antenna as set forth in claim 4 wherein the radiating elements are positioned 180° apart by the inductive post.

6. The antenna as set forth in claim 4 wherein the radiating elements are fed 180° out-of-phase to produce maximum radiation in the forward direction.

7. The antenna as set forth in claim 3 wherein the conductive plating and shorting means define four radiating elements linearly aligned.

8. The antenna as set forth in claim 7 wherein the stripline feed network comprises two separate transmission lines for feeding the four radiating elements.

9. The antenna as set forth in claim 8 wherein the radiating elements are fed alternately, one transmission line acting as a receiving network, the other as a transmitting network.

10. The antenna as set forth in claim 3 wherein the conductive plating and shorting means define four radiating elements in a rectangular array.

11. The antenna as set forth in claim 10 wherein the stripline feed network comprises a balanced transmission emanating from the same feed point and coupling each pair of radiating elements.

12. The antenna as set forth in claim 3 wherein the radiating region of each element is between one-half and one wavelength long.

* * * * *